US008757124B2

(12) United States Patent
Hoeg

(10) Patent No.: US 8,757,124 B2
(45) Date of Patent: Jun. 24, 2014

(54) MOVABLE WALL MEMBER IN FORM OF AN EXHAUST VALVE SPINDLE OR A PISTON FOR INTERNAL COMBUSTION ENGINE, AND A METHOD OF MANUFACTURING SUCH A MEMBER

(75) Inventor: Harro Andreas Hoeg, Allerod (DK)

(73) Assignee: Man Diesel, Filial AF Man Diesel SE, Tyskland, Copenhagen (DK)

( * ) Notice: Subject to any disclaimer, the term of this patent is extended or adjusted under 35 U.S.C. 154(b) by 248 days.

(21) Appl. No.: 12/666,548

(22) PCT Filed: Jan. 23, 2009

(86) PCT No.: PCT/DK2009/050024

§ 371 (c)(1),
(2), (4) Date: Dec. 23, 2009

(87) PCT Pub. No.: WO2010/083831

PCT Pub. Date: Jul. 29, 2010

(65) Prior Publication Data

US 2011/0209468 A1 Sep. 1, 2011

(51) Int. Cl.
*F02F 3/00* (2006.01)

(52) U.S. Cl.
USPC ..... 123/193.6; 123/41.35; 123/41.41; 123/188.3; 123/668; 29/888.4; 92/223

(58) Field of Classification Search
USPC ..... 123/193.6, 41.41, 188.3, 668, 41.35; 29/88.048, 888.4; 92/223
See application file for complete search history.

(56) References Cited

U.S. PATENT DOCUMENTS 3,969,109 A * 7/1976 Tanczyn ..... 420/40
4,798,770 A * 1/1989 Donomoto et al. ..... 428/547

(Continued)

FOREIGN PATENT DOCUMENTS

JP 61-40008 U 4/1986
JP 63169327 A 7/1988

(Continued)

OTHER PUBLICATIONS

M G Kingston-Jones et al., "Review of operating experience with current valve material", Diesel Engine Combustion Chamber Materials for Heavy Fuel Operation, Industry Valve Project, 1990, pp. 15-28.

(Continued)

*Primary Examiner* — Marguerite McMahon
*Assistant Examiner* — James Kim
(74) *Attorney, Agent, or Firm* — Sughrue Mion, PLLC

(57) ABSTRACT

A movable wall member, in form of an exhaust valve spindle (1) or a piston (7) for an internal combustion engine, comprises a base portion (17, 20) of an alloyed steel having a carbon-content in the range from 0.15 to 0.35% by weight, and an outer portion (14, 5) forming the surface of the wall member facing a combustion chamber. The outer portion is of a hot-corrosion-resistant alloy, which is nickel-based, chromium-based or cobalt-based. At least one buffer layer (18, 21) of an alloy is located in between the base portion and the outer portion. The alloy of the buffer layer is different from the alloyed steel of the base portion and different from the hot-corrosion-resistant alloy of the outer portion. The alloy of the buffer layer comprises from 0% to at the most 0.09% C in percent by weight of the buffer layer, and that the buffer layer has a thickness of at least 1.5 mm.

14 Claims, 3 Drawing Sheets

(56) References Cited

U.S. PATENT DOCUMENTS

Figure 1:
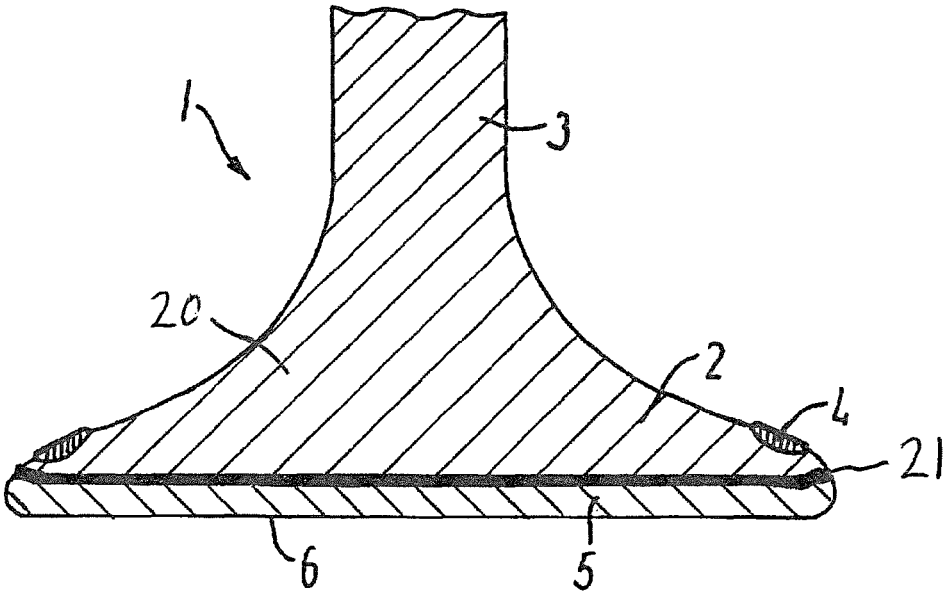

| | | | | |
|---|---|---|---|---|
| 4,848,291 | A * | 7/1989 | Kawamura et al. | 123/193.6 |
| 4,952,454 | A | 8/1990 | Iwamoto et al. | |
| 4,976,806 | A | 12/1990 | Iwamoto et al. | |
| 5,282,411 | A * | 2/1994 | Hirai et al. | 92/176 |
| 5,316,599 | A | 5/1994 | Ebato et al. | |
| 6,173,702 | B1 * | 1/2001 | Hoeg | 123/668 |
| 6,244,234 | B1 | 6/2001 | Hoeg | |
| 6,656,600 | B2 * | 12/2003 | Strangman et al. | 428/472 |
| 7,767,038 | B2 * | 8/2010 | Kim | 148/326 |

FOREIGN PATENT DOCUMENTS

| | | | |
|---|---|---|---|
| JP | 04-041606 | A | 2/1992 |
| JP | 08165547 | A | 6/1996 |
| JP | 11200946 | A | 7/1999 |
| JP | 2005201101 | A | 7/2005 |
| WO | 79/01103 | A1 | 12/1979 |
| WO | 96/18747 | A1 | 6/1996 |
| WO | 97/43525 | A1 | 11/1997 |
| WO | 2004/030850 | A | 4/2004 |

OTHER PUBLICATIONS

Japanese Notice of Allowance for Application S.N.: 2010-547047; Jul. 4, 2012.

Review of Operating Experience With Current Valve Materials (Paper 2); The Institute of Marine Engineers; 1990.

* cited by examiner

MOVABLE WALL MEMBER IN FORM OF AN EXHAUST VALVE SPINDLE OR A PISTON FOR INTERNAL COMBUSTION ENGINE, AND A METHOD OF MANUFACTURING SUCH A MEMBER

The present invention relates to a movable wall member in form of an exhaust valve spindle or a piston for an internal combustion engine, particularly a two-stroke crosshead engine, which moveable wall member comprises a base portion of an alloyed steel having a carbon-content in the range from 0.15 to 0.35% by weight, and an outer portion forming the surface of the wall member facing a combustion chamber, which outer portion is of a hot-corrosion-resistant alloy, which is nickel-based, chromium-based or cobalt-based.

U.S. Pat. No. 6,173,702 describes a known movable wall member of this kind where the corrosion-resistant outer portion is provided onto the base portion by powder-metallurgy processing where particulate material of the corrosion-resistant alloy is placed in a mould on the base portion and unified with the latter in a HIP process (Hot Isostatic Pressure). Due to the use of powder-metallurgy and the HIP process the resulting outer portion obtains an advantageously low hardness of less than 310 HV. The low hardness assists in avoiding cracks in the material due to heat stresses occurring in use of the wall member.

WO 96/18747 describes a known movable wall member of the same kind where the outer portion has been welded onto the base portion.

The upper piston surface and the lower valve disc surface have large areas and are therefore exposed to considerable heat stresses when the engine load is changed, for example when the engine is started or stopped. The heat impact is heaviest at the middle of the areas, partly because the combustion gases have the highest temperature near the middle of the combustion chamber, partly because the piston and the valve spindle are cooled near the edges of the areas. The valve disc is cooled near the seat areas on the upper surface, which is in contact with the water-cooled stationary valve seat while the valve is closed, and as for the piston heat is conducted away to the water-cooled cylinder liner through the piston rings in addition to the oil cooling of the inner piston surface. The colder peripheral material prevents thermal expansion of the hotter central material, and thus causes considerable heat stresses. It is well-known that the slowly varying, but large heat stresses caused by said thermal influences can cause star cracking initiated at the middle of the lower surface of the valve disc. The star cracks may become so deep that the hot-corrosion-resistant material is penetrated so that the subjacent material is exposed to the corrosive impact and is eroded, leading to failure of the exhaust valve.

The hot-corrosion-resistant alloys containing chromium and nickel are known to age harden at temperatures ranging from 550° C. to 850° C., in particular when they are provided in cast form, and consequently these alloys become harder and more brittle during use of the wall member. When the wall member is provided with a cast alloy of this type, such as an alloy of about 50% Cr and 50% Ni or an alloy of the type INCONEL 657 (INCONEL is a trademark of Special Metals, U.S.A.), the alloy comprises a nickel-rich phase and a chromium-rich phase, and these phases do not solidify in an equilibrium state when the alloy cools off after casting. When the alloy is brought to the operating temperature in the combustion chamber of the internal combustion engine, precipitation of the under-represented phase proportion occurs by transformation of the over-represented phase proportion, which causes embrittlement resulting in a ductility of typically less than 4% at room temperature. The transformation typically results in formation of areas with pearlite-structure, which is flake-shaped and causes embrittlement.

Due to the heavy thermal loads occurring in the movable wall members during operation in the engine there is a need for suppressing or avoiding metallurgical processes causing a reduction of ductility in areas within the wall member.

With a view to this the movable wall member according to the present invention is characterized in that at least one buffer layer of an alloy is located in between the base portion and the outer portion, that the alloy of the buffer layer has a composition different from the alloyed steel of the base portion and different from the hot-corrosion-resistant alloy of the outer portion, that the alloy of the buffer layer comprises from 0% to at the most 0.09% C in percent by weight of the buffer layer, and that the buffer layer has a thickness of at least 1.5 mm.

The base portion of alloyed steel has a higher content of carbon than the corrosion resistant alloy of the outer portion, and the carbon can be bound within the material in different manners that result in variations in the tendency of carbon to diffuse, even for alloys having the same content of C in percent by weight. The tendency of carbon to diffuse out of a particular alloy, and into a neighbouring other alloy, may be called the carbon-activity of the alloy. The nickel-based alloys having high contents of chromium have a strong tendency of binding carbon in carbides, however carbon bound in this manner in the alloy seems not to contribute to the carbon-activity of the alloy. When carbon in the alloy is transformed into carbides it so to say disappears and the carbon-activity of the alloy is lowered. The diffusion rate of carbon in the alloys is temperature dependent and thus primarily takes place when the wall member is at elevated temperatures, such as during the manufacturing of the wall member, and during operation of the internal combustion engine. Such carbon diffusion may thus occur during extended time, and the effects of diffusion may occur only after long-time operation of the wall member.

In the prior art movable member the hot-corrosion-resistant alloy is deposited directly on the alloyed steel of the base portion. The hot-corrosion-resistant alloy contains elements acting to promote formation of carbides. Carbon thus has a continuous tendency to diffuse into the hot-corrosion-resistant alloy and form carbides in the interface area, which area may become more brittle due to the concentration of carbides in or near the bounding area between the two alloys.

The location of the buffer layer in between the base portion of alloyed steel and the outer portion and the carbon content in the buffer layer from 0% to at the most 0.09% C in percent by weight have the effects firstly that the alloyed steel is directly in contact with only the material of the buffer layer and not with the corrosion-resistant alloy of the outer layer, and secondly that carbon activity of the base portion is higher than the carbon activity of the buffer layer so that carbon diffuses out of the alloyed steel and into the buffer layer.

However, the diffusion rate of carbon out of the base portion is significantly lower than in the prior art wall members where the alloyed steel is in contact with the corrosion resistant alloy. The diffusion rate is lower because the carbon diffusing into the buffer layer contributes to increase the carbon activity of the buffer layer and thus gradually over time reduces the difference in carbon activities of the base portion and the buffer layer, and any carbon content in the buffer layer alloy also in itself cause a level of carbon activity. Due to the gradual building up over time of carbon level in the buffer layer zone neighbouring a first interface area between the buffer layer and the base portion, the depletion of carbon from the alloyed steel at the interface area will gradually decrease.

The level of carbides in the alloyed steel will thus over time not be so low as in the prior art wall members, and larger concentrations of carbides in the interface area is avoided. The maintenance of carbides is of importance because the carbides act in the alloyed steel to restrict grain growth. If the level of carbides were to become low in a local area near the first interface area then grain growth could be a result, and the larger grains would cause a weakening of the mechanical strength of the alloy. Such weakening near or at the first interface area could result in crack formation, especially if it occurred in an area subjected to the above-mentioned large heat stresses caused by thermal influences. The buffer layer thus acts to counteract or prevent such failures in the alloyed steel of the base portion.

The carbon content in the buffer layer is, in the newly manufactured movable wall member restricted to at the most 0.09% C. This has the positive effect that carbon diffusion into the corrosion-resistant alloy of the outer layer is significantly lower than in the prior art wall members, because the carbon activity at a second interface area between the buffer layer and the outer portion depends on this carbon content. The lower carbon content in the buffer layer thus results in less creation of carbides in the corrosion resistant alloy, and in this alloy such carbides are undesired, especially if they precipitate in the structure as boundary layers on the grains. The ductility of the corrosion resistant alloy is the highest when the carbon content is low, and any reduction in carbon diffusing into the corrosion resistant alloy has a positive effect on maintaining the desired ductility of the outer portion and in the second interface area. As explained in the above, carbon will diffuse into the buffer layer over time, and will cause an increased carbon level therein. If the buffer layer is thin, carbon will during the life of the wall member diffuse from the alloyed steel of the base portion through the buffer layer and further on into the corrosion resistant alloy in the outer portion. A thin buffer layer will consequently loose its effect after some time in operation. On the other hand, when the buffer layer has a thickness of at least 1.5 mm, the buffer layer is expected to be capable of remaining effective during at least the major part of or throughout the complete operational life of the moveable wall member.

The alloy of the buffer layer has a composition different from the alloyed steel of the base portion and different from the hot-corrosion-resistant alloy of the outer portion means. The difference in composition means that the analysis of the alloy of the buffer layer differs in alloying components or in the amounts (in percentage of weight) of one or more of the alloying components. The buffer layer may e.g. be an alloyed steel with a different amount of carbon or different amounts of other components, such as chromium, iron or nickel. The term composition is thus to be taken to mean the analysis of the alloys. The ductility problem of the movable wall member is thus solved by the combined features of a buffer layer; a maximum content of carbon in the buffer layer selected to be significantly lower than the carbon content in the alloyed steel of the base portion; and a minimum thickness of the buffer layer of 1.5 mm in order to create such large separation between the alloy of the base portion and the alloy of the outer portion that the distance is so long that diffusion of carbon across the buffer layer in significant amounts cannot occur during the operational life of the movable wall member.

In a preferred embodiment the buffer layer is of steel. The advantage of using steel as buffer layer is its ability to bind well with both the alloyed steel of the base portion and the corrosion resistant alloy of the outer portion, and steel can without adverse effects to strength absorb the carbon that diffuses into the buffer layer from the base portion. In an even more preferred embodiment the steel of the buffer layer is austenitic steel. The austenitic crystal structure is face centred cubic (FCC), and this structure is more dense than the body centred cubic (BCC) structure of martensitic steels. The more dense structure of austenitic steels results in slower diffusion of carbon in the structure. And in the austenitic steel the formation of carbides increases the strength of the steel.

In an alternative embodiment the buffer layer is of a nickel-based alloy. An alloy of this type is particularly suitable for binding well with the alloy of the outer portion, and it may have a content of chromium that is considerably lower than the outer portion, such as a chromium content of less than 25% by weight, such as the alloy IN 625 having from 20 to 23% chromium, the alloy INCOLOY 600 having from 19 to 23% chromium, or the alloy IN 718 having 10 to 25% chromium, or the alloy NIMONIC Alloy 105 having about 15% chromium, or the alloy Rene 220 having from 10 to 25% chromium, and in each case the content of carbon has to be limited to the amount of at the most 0.09%. The buffer layer may also be of a more nickel-rich alloy as nickel in larger amounts has a tendency to prevent diffusion of carbon.

In another embodiment the buffer layer is, apart from unavoidable impurities, of Fe or Ni. One advantage of making the buffer layer of pure, or almost pure, iron or nickel is that the buffer layer has no or only very small amounts of carbide formants. When this is the case, the formation of carbides in the buffer layer is suppressed, and diffusion of carbon into the buffer layer increase the carbon-activity in the buffer layer and thus further diffusion of carbon into the layer will be avoided. Carbon only has very small solubility in iron and nickel. As an example, the solubility of carbon in nickel at a temperature of 500° C. is less than 0.1% by weight, so when even small amounts of carbon has diffused into the buffer layer, the buffer layer will obtain a carbon-activity of 100% and thus virtually prevent further diffusion of carbon into the layer.

In one embodiment the movable wall member is an exhaust valve spindle, and the alloyed steel of the base portion is an austenitic, stainless steel. For years it has been accepted to make the complete valve spindle out of the alloy NIMONIC 80 A, or possibly of another alloy with a hardfacing in the valve seat area. These special alloys are, however, not so easily available as austenitic, stainless steel, and the stainless steel also has high strength and is considered all in all to perform very well, especially in two-stroke crosshead engines, provided the corrosion resistance can be improved above the capabilities of stainless steel on the surface facing the combustion chamber, and optionally also in the seat area of the valve. The stainless steel, however, has a rather high content of carbon. In connection with the present invention problems of the carbon content is solved by the buffer layer, so the advantages of utilizing stainless steel for the major part of the exhaust valve are not impaired by the high requirements for hot-corrosion resistance and for long-term ductility of the completed exhaust valve. The buffer layer makes it possible to use any suitable hot-corrosion resistant alloy for the outer portion facing the combustion chamber.

In another embodiment the movable wall member is a piston. The piston typically has a base portion of alloyed steel, but not of stainless steel. The buffer layer is provided on top of the base portion, and the outer portion on top of the buffer layer. Due to the effects of the buffer layer, there is a rather free choice in the selection of the alloy for the outer portion. The selection of the alloy need not be done according to considerations of how the alloy will interact with the alloyed steel of the base portion, but instead the alloy may be selected according to obtaining high corrosion resistance during the operational conditions for the piston.

The thickness of the buffer layer may be less than 1.5 mm, in particular when the buffer layer is of Fe or Ni where the carbon-activity reaches 100% after diffusion of some carbon into the buffer layer. In these cases where the buffer layer is capable of obtaining a carbon-activity of about 100% this will in itself prevent further diffusion of carbon into the buffer layer, and the thickness of the layer is then of less importance to the diffusion of carbon. On the other hand the buffer layer should be able to separate the alloy of the base portion from the alloy of the outer portion in a safe manner, and a very thin buffer layer may be penetrated by particles of one of the portions. It is thus preferred that the buffer layer has sufficient thickness to clearly separate the two portions from one another, and a thickness of 1.5 mm may suffice in this respect.

In a preferred embodiment the buffer layer has a thickness of at least 2 mm. This thickness is sufficient to ensure that carbon cannot diffuse across the buffer layer, even when the buffer layer is of an alloy exhibiting carbide formation abilities where the carbon diffusing into the layer can be converted into carbides and thus not cause an increase in the carbon-activity of the layer.

The present invention also relates to a method of manufacturing a movable wall member in form of an exhaust valve spindle or a piston for an internal combustion engine, wherein a base portion of the moveable wall member is provided, which base portion comprises an alloyed steel having a carbon-content in the range from 0.15 to 0.35% by weight, and an outer portion is provided, which outer portion is of a hot-corrosion-resistant alloy, which is nickel-based, chromium-based or cobalt-based. The method according to the invention is characterized by placing a buffer layer on the base portion and then placing the outer portion on the buffer layer, which buffer layer is of an alloy comprising from 0% to at the most 0.09% C in percent by weight of the buffer layer, said base portion, buffer layer and outer portion being unified to a coherent wall member. The movable wall member manufactured in this manner possesses the above-described advantageous properties.

Preferably, the buffer layer is a sheet of plate placed on the base portion, and the outer portion is deposited on the outer surface of the sheet of plate. One advantage of placing the buffer layer as a sheet of plate on the base portion is the ease by which the wall member may be manufactured. The sheet of plate can be pre-machined to desired dimensions and simply be placed as a single part onto the base portion. The material for the outer portion is then deposited on the sheet, such as by being deposited by pouring particles into a receptacle mounted on the base portion. The particles and the sheet of plate may then be united into a coherent wall member in a HIP process. The use of a sheet of plate as the buffer layer has the additional advantage that it has a flat contact surface towards the surface of the base portion, and also a flat contact surface towards the material of the outer portion. The flat surface has minimum contact area to the material of the portion united with the buffer layer and thus a minimum area for diffusion of carbon. And the binding of carbon in the buffer layer occurs in an even manner when the diffusion occurs across a flat bounding area.

In an embodiment the base portion is a pre-machined blank of forged valve steel, and the outer portion is a nickel-based alloy provided as a particulate material which is unified by a HIP process substantially without melting the particulate material. The blank of forged valve steel is manufactured in well-known manner, and is then used as basis for building up the buffer layer and the outer portion.

As an alternative to providing the buffer layer as a sheet of plate it may be provided as a particulate material, which is unified by a HIP process. This may facilitate the manufacturing when the outer portion is provided as particulate material, as both materials may then be HIP treated in a single process. The particulate material for the buffer layer may also be used when the outer portion is not provided as particulate material, and in this instance the particulate material for the buffer layer may be chosen in order to achieve a buffer layer having a very precise structure, as the particulate material in combination with the HIP process provides great control over the structure.

In yet an alternative, the buffer layer is deposited on the base portion by welding. A weld deposited buffer layer may be useful when the buffer layer is of steel, or of a material well suited for welding.

Figure 2:
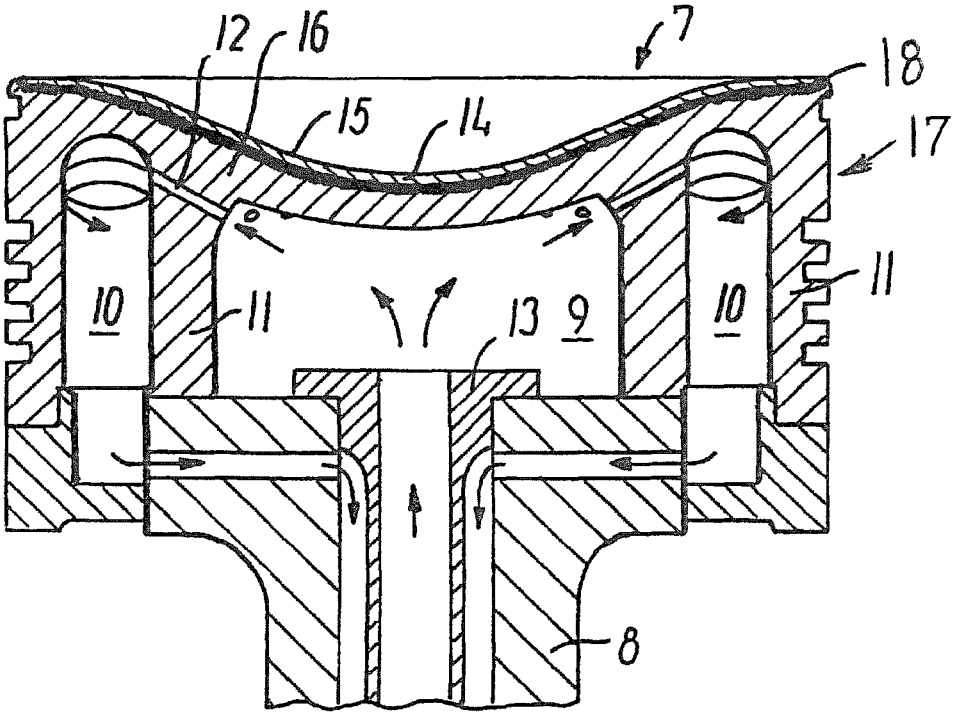
Figure 3:
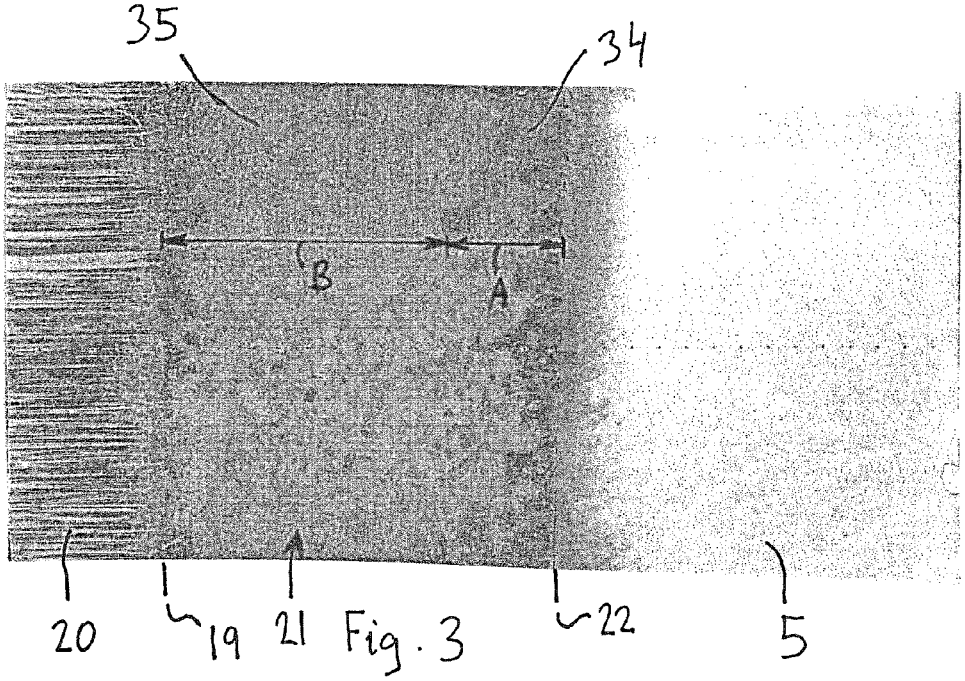
Figure 4:
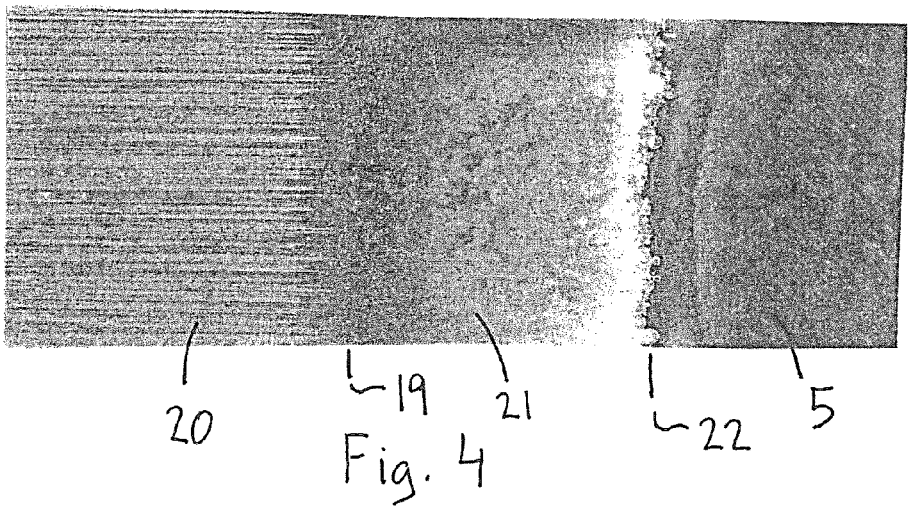
Figure 5:
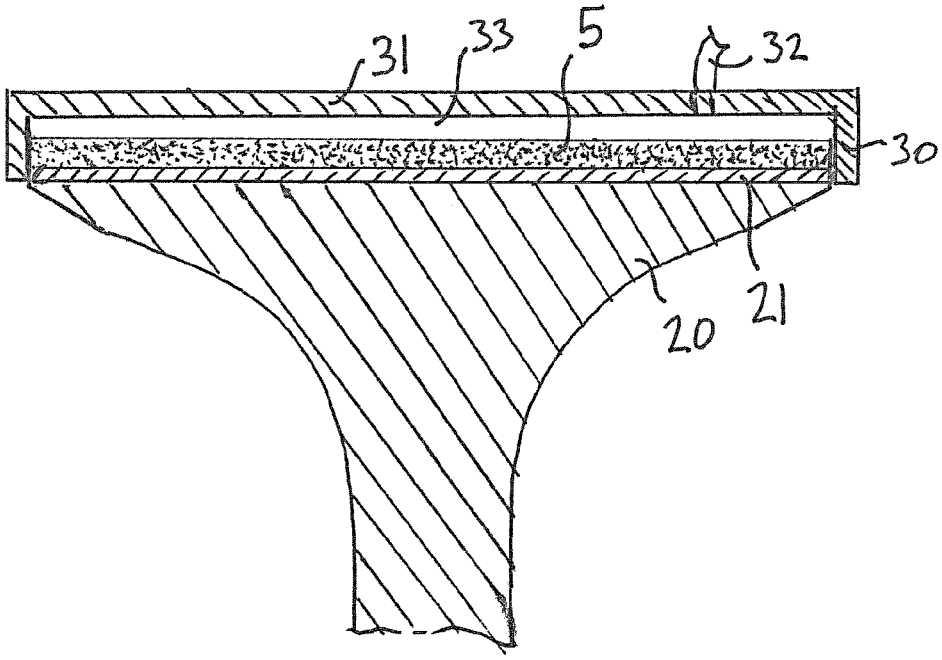
Figure 6:
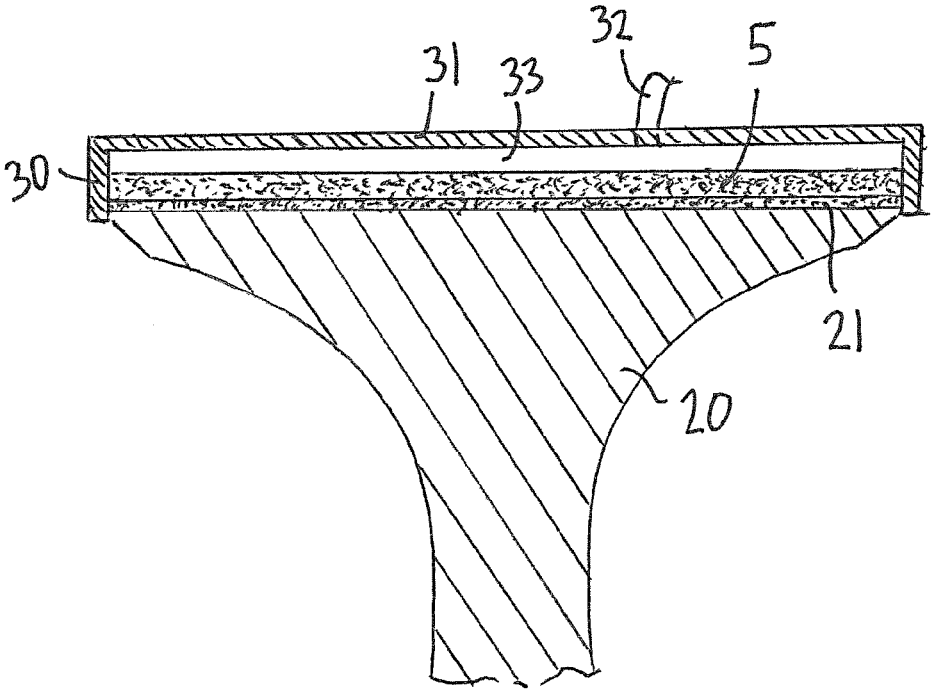

Examples of embodiments according to the present invention are in the following described in more detail with reference to the highly schematic drawings, on which FIG. 1 illustrates a cross-sectional part view of a movable wall member in form of an exhaust valve according to the invention, FIG. 2 illustrates a cross-sectional view of a movable wall member in form of a piston according to the invention, FIG. 3 is a cut out and polished piece of the movable wall member from the area surrounding a buffer layer, where the buffer layer has been provided as a sheet of plate and the outer portion has been provided as a particulate material, FIG. 4 is a cut out and polished piece of the movable wall member from the area surrounding a buffer layer, where both the buffer layer and the outer portion have been provided as a particulate material, FIG. 5 is an illustration showing a first arrangement of the parts before a HIP process, and FIG. 6 is an illustration showing a second arrangement of the parts before a HIP process.

FIG. 1 illustrates in schematic form a wall member in the form of a valve spindle 1 for an exhaust valve for a two-stroke crosshead engine. The valve spindle comprises base portion generally designated 20 and comprising a valve disc 2 and a valve shaft 3, of which only the bottom part is shown. A valve seat 4 at the upper surface of the valve disc is manufactured in a hot-corrosion-resistant alloy suitable for counteracting the formation of dent marks on the sealing surface of the seat. The lower surface of the valve disc has an outer portion 5 of a layer of hot-corrosion resistant material counteracting the burning off of material from a downward facing outer surface 6 of the disc. A buffer layer 21 is located between base portion 20 and outer portion 5. When the engine is in operation the exhaust valve is moved, at suitable times of the engine cycle, between a closed position, where the valve seat abuts a stationary valve seat (not shown), and an open position, where the valve has been moved downward and the valve seat 4 is at a distance from the stationary valve seat.

FIG. 2 illustrates a wall member in the form of a piston 7 having a base portion 17 mounted on top of a piston rod 8, of which only the top part is shown. The base portion comprises in this embodiment a lower portion of a piston top 16 and a piston skirt 11. The piston has a central cavity 9 and many vertical bores 10 evenly distributed along the piston periphery in the piston skirt 11 encircling the cavity 9. Through smaller bores 12 the cavity 9 is connected with the vertical bores 10 so that cooling oil from a central tube 13 in the piston rod can flow into the cavity and further through the bores 12 into the vertical bores 10, from where the oil returns through the piston rod. Arrows indicate the flow path of the cooling oil.

The cooling oil cools the lower surface of the piston top 16, but nevertheless temperature differences will occur at the upper surface of the piston top with resulting heat stresses in its material. The piston may, of course, also be of other designs, for example a large number of spraying tubes may be inserted in a piston bottom for spraying cooling oil up against the lower surface of the piston top, the central cavity may have a larger diameter so that the cooling of the piston top is mainly carried out by means of splash cooling, and the shape of the piston top may be different, such as having an central portion bulging upwards instead of downwards.

At its upper surface the piston top has an outer portion 14 of a hot-corrosion-resistant material counteracting burning off of material from the upward surface 15 of the piston. A buffer layer 18 is located between base portion 17 and outer portion 14. When the engine is in operation, the piston is reciprocated in a cylinder liner (not shown).

The movable wall members 1, 7 together with the cylinder liner and a cylinder cover (not shown) define the combustion chamber of the engine and are thus exposed to the hot and aggressive environment occurring at the combustion process.

The internal combustion engine utilizing the movable wall members may be a four-stroke engine or a two-stroke crosshead engine. The two-stroke engine may be of the make MAN Diesel, such as of the type MC or ME, or may be of the make Wärtsilä, such as of the type RTA of RTA-flex, or may be of the make Mitsubishi. For such two-stroke crosshead engines the diameter of the piston may range from 250 to 1100 mm, and the outer diameter of the disc of the valve spindle may range from 120 to 600 mm, and typically be at least 170 mm. From these dimensions it is clear that the surfaces of the movable wall members facing the combustion chamber have large areas, which give rise to large heat stresses in the outer portion 5, 14 and in the interface areas between the buffer layer and the outer portion and the base portion, respectively.

The advantageous properties of the movable wall members 1 and 7 can also be exploited in smaller engines, for example four-stroke engines of the medium or high-speed type, but they are especially applicable in the two-stroke crosshead engines, which are large engines where the loads are heavy and the requirement of continuous operation without failure is dominant.

The movable wall member 1, 7 has a buffer layer 21, 18 located in between the base portion 20, 17 and the outer portion 5, 14. For the sake of simplicity the movable wall member 1, 7 will in the following be denoted only 1, the buffer layer 21, 18 will be denoted only 21, the base portion 20, 17 will be denoted only 20, and the outer portion 5, 14 will be denoted only 5, but it is to be understood that the following description anyhow applies likewise to both the exhaust valve and the piston.

FIGS. 3 and 4 are photographs of samples cut out from wall member 1 in the area of the buffer layer. The samples have been polished. The left hand side of the photographs show horizontal forging texture in parallel lines where carbides have been partially dissolved during the etching process. Next to (below) the photographs markings have been made in order to indicate the extent of the portions and of the buffer layer. A first interface area 19 is located at the transition from the alloy of the base portion 20 to the alloy of the buffer layer 21, and a second interface area 22 is located at the transition from the alloy of the buffer layer to the alloy of the outer portion. The buffer layer thus has a thickness largely corresponding to the distance between the interface areas 19 and 22.

The sample of FIG. 3 has been taken from a wall member where the buffer layer 21 is composed of a plate of steel 34 in combination with a layer 35 of particulate material. The base portion is of forged valve steel (SNCrW—Alloy 1 in Table I), the outer portion 20 is of Alloy 671, the plate of steel 34 is of the alloy W.-No. 1.4332 in Table 2, and the layer 35 is of the alloy UNS 531603 comprising 0.5-1.0% Mn, 16.5-18% Cr, 11.5-14% Ni, 2.5-3.0% Mo, 0-0.1% N, 0-0.025% oxygen, and the balance Fe. It appears from FIG. 3 that the interface areas 19 and 22—and in particular 22 towards the outer portion—are well defined with a rather sharp transition from the one alloy to the other. This is due to flat surfaces on the plate used as buffer layer. The base portion 20 has near the interface area 19 an area that appears somewhat darker and without parallel lines from forging texture. In this area the carbon content in the alloy is lower due to the diffusion of carbon into the buffer layer. And also the outer portion 5 has near the interface area 22 an area that appears somewhat darker, and this is due to a slightly higher carbon content caused by diffusion of carbon into the outer portion.

The sample of FIG. 4 has been taken from a wall member where the buffer layer 21 has been provided as particulate material of alloy UNS S31603 and the outer portion 5 also has been provided as particulate material of Alloy 671. The base portion 20 is of the same forged steel as in the sample presented in FIG. 3. The interface area 22 is seen to be more diffuse than in FIG. 3, and the reason for this is that the particulate material of the buffer layer does not provide a sharp transition from the one to the other material, and a slight blending of the particulate materials of the buffer layer and the particulate material of the outer layer may occur when the HIP process is common for both materials. The slight blending may be minimized by using a two-step procedure where, in a first step, the particulate material of the buffer layer is provided on the base portion, and a HIP procedure is performed so that the particulate material is consolidated and unified, and in a second step the particulate material of the outer portion is provided on the buffer layer, and a HIP procedure is performed so that the particulate material is consolidated and unified. In FIG. 4 the diffusion of carbon from the base portion 20 into the buffer layer is seen as a more dark area in the left hand side of the buffer layer, and the diffusion of carbon from the outer portion 5 into the buffer layer is seen as a more bright area in the left hand side of the outer layer.

FIGS. 5 and 6 illustrate in a highly schematic manner two examples of how to provide the particulate material and to perform the HIP procedure. In the example of FIG. 5 the buffer layer is provided as a sheet of plate pre-cut to a circular shape, which is placed on top of the base portion while the base portion is held with its end face facing upwards. Then particulate material of the outer portion 5 is placed on top of the sheet of plate. In order to obtain an even layer, also in the areas close to the outer rim of the plate, an annular ring may be located around the rim of the plate. The particulate material is dosed in an amount provided the desired thickness of the outer portion and is evened out to a layer of uniform thickness. The thus arranged base portion, plate and outer portion is then placed in a chamber and the area around the particulate material is evacuated. This is illustrated only in principle by the horizontal plate 31 and the evacuation tube 32 leading to the evacuation chamber 33. HIP processing equipment is standard equipment, and the skilled person is well aware of how practical embodiments for HIP processing are designed.

After the evacuation the parts are heated to the desired HIP temperature and the pressure is increased to standard HIP pressure. Temperature and pressure are maintained for extended time, such as 11 hours. During this time the individual parts consolidate and unifies into a coherent and dense wall member. The HIP process may e.g. use a HIP temperature ranging from 950 to 1200° C., and a HIP pressure of, for example, 900 to 1200 bar. At these conditions the particulate material becomes plastic and is unified to a coherent, dense material substantially without melting. And the material of the buffer layer also unifies with base portion 20. When the HIP process is completed the wall member is removed and, if necessary, machined to the desired dimensions.

In order to better utilize the oven used for the HIP process the exhaust valve head may be forged as a separate part, without the stem, and then be subjected to positioning of the buffer layer and the outer layer on the exhaust valve head, where after the HIP procedure is carried out, and then the stems may be friction-welded onto the valve heads. In this manner the stem arts of the valves do not occupy space in the oven.

In the example of FIG. 6 the buffer layer is provided as a first layer of particulate material, and this material is placed on top of the base portion while the base portion is held with its end face facing upwards. In order to obtain an even layer, also in the areas close to the outer rim of the plate, an annular ring may be located around the rim of the plate. The particulate material is dosed in an amount provided the desired thickness of the buffer layer and is evened out to a layer of uniform thickness. Then the ring 30 is lifted a distance upwards to the position suitable for placing the second layer of particulate material to constitute the outer portion 5. The second layer is placed on top of the first layer of particulate material. The particulate material is dosed in an amount provided the desired thickness of the outer portion and is evened out to a layer of uniform thickness, and then the HIP process is performed as described in connection with FIG. 5.

The particulate materials may, for example, have been manufactured by atomisation of a liquid jet of a melted alloy of the desired composition into a chamber with an inactive atmosphere, whereby the drop-shaped material is quenched and solidifies as particles with the very fine dendritic structure. The particulate material may also be called a powder.

Suitable materials for the base portion comprise standard alloyed steels, when the wall member is a piston. When the wall member is an exhaust valve stainless steels may be used. Examples of such materials are given in the following Table 1. The W.-No. is the German standard number for the alloy. The percentages stated are percentages by weight.

TABLE 1

| W.-No. | C | Si | Mn | Cr | Ni | Other | Balance |
|---|---|---|---|---|---|---|---|
| Alloy 1 | 0.25% | 1.4% | 1.3% | 20% | 9% | 3% W | Fe |
| — | 0.35% | 2.5% | 0.8% | 11.5% | — | 1% Mo | Fe |
| 1.4873 | 0.43% | 2.3% | 1.2% | 18% | 9% | 1% W | Fe |
| 1.4718 | 0.45% | 3.2% | 0.4% | 9% | — | — | Fe |
| 1.4871 | 0.52% | — | 9% | 20.8% | 3.9% | 0.45% N | Fe |
| 1.4747 | 0.81% | 2% | — | 19.5% | 1.4% | — | Fe |

Suitable materials for the buffer layer comprise steels as exemplified in the following Table 2. The W.-No. is the German standard number for the alloy. The percentages stated are percentages by weight.

TABLE 2

| W.-No. | C | Si | Mn | Cr | Ni | Other | Balance |
|---|---|---|---|---|---|---|---|
| 1.4370 | 0.08% | 0.8% | 7% | 18% | 8% | — | Fe |
| 1.4316 | 0.03% | 0.5% | 1.5% | 20.5% | 10.5% | Nb > 12 × C | Fe |
| 1.4551 | 0.04% | 0.8% | 1.8% | 19.5% | 10% | — | Fe |
| 1.4430 | 0.025% | 0.8% | 1.8% | 18.5% | 12% | 2.6% Mo | Fe |
| 1.4332 | 0.03% | 0.5% | 1% | 24.5% | 13% | — | Fe |
| — | 0.08% | 0.8% | 1.8% | 23.5% | 13.5% | — | Fe |

Another suitable material for the buffer layer is the alloy UNS S31603 comprising 0.5-1.0% Mn, 16.5-18% Cr, 11.5-14% Ni, 2.5-3.0% Mo, 0-0.1% N, 0-0.025% O, and the balance Fe. When the buffer layer is of plate material then there is normally not any requirements to the contents of nitrogen and oxygen. However, when the buffer layer is of particulate material then it is preferred that the content of nitrogen is at the most 0.1% and preferred that the content of oxygen is at the most 0.03%

Suitable materials for the outer portion are well known in the art of exhaust valves, and examples are Stellite 6, an alloy of the type 50% Cr and 50% Ni, an alloy of the type IN 657 comprising 48-52% Cr, 1.4-1.7% Nb, at the most 0.1% C, at the most 0.16% Ti, at the most 0.2% C+N, at the most 0.5% Si, at the most 1.0% Fe, at the most 0.3% Mg, and a balance of Ni. Another example is an alloy having the following composition 40 to 51% Cr, from 0 to 0.1% C, less than 1.0% Si, from 0 to 5.0% Mn, less than 1.0% Mo, from 0.05% to less than 0.5% B, from 0 to 1.0% Al, from 0 to 1.5% Ti, from 0 to 0.2% Zr, from 0.5 to 3.0% Nb, an aggregate content of Co and Fe of maximum 5.0%, maximum 0.2% O, maximum 0.3% N and the balance Ni. Other suitable facing alloys for use as the outer portion are given in the article "Review of operating experience with current valve materials", published in 1990 in the book "Diesel engine combustion chamber materials for heavy fuel operation" from The Institute of Marine Engineers, London.

The buffer layer and the outer portion may also be provided in other manners, such as the following. The buffer layer may be a plate of steel of an alloy as mentioned in Table 2, and the outer layer may also be plate-shaped. The two plates are then placed on top of the base portion and a HIP process is carried out to unify the three parts to a coherent wall member. The outer portion may alternatively be welded onto this plate of the buffer layer. As an alternative the outer portion may be provided as a plate-shaped member, and this may be unified with the base portion by using a vacuum soldering process with a nickel-based solder. The solder is used in an amount creating a solder layer of at least 1.5 mm so that the solder constitutes the buffer layer.

More than one buffer layer may separate the outer portion from the base portion. It is possible to use one buffer layer from a sheet (plate) like material in combination with a second buffer layer from particulate material of the same alloy or another alloy than the alloy of the sheet. The buffer layers, whether two, three, four or more in numbers, may also be of mutually different alloys.

The maximum of 0.09% C in the buffer layer applies to a newly manufactured movable wall member. During use carbon may diffuse from one alloy to another as described in the above.

It is possible to combine details of the above-mentioned embodiments into other embodiments within the scope of the patent claims. It is furthermore possible within the scope of the patent claims to make variations in the details of the above-described embodiments. The valve seat 4 may e.g. be of the same alloy as the valve disc, the buffer layer 21 may end at the valve seat 4 and have a more vertical or a vertical extent at the largest diameter (in the area below the valve seat 4). The buffer layer may extend across only a part of the diameter of the valve disc, but should preferably be present in the central area of the valve disc where the thermal loads are the largest.

The invention claimed is:

1. A movable wall member in form of an exhaust valve spindle for an internal combustion engine, which exhaust valve spindle comprises:

a base portion of an austenitic, stainless steel having a carbon-content in the range from 0.15 to 0.35% by weight, and an outer portion forming a surface of the wall member for facing a combustion chamber, which outer portion is of a hot-corrosion-resistant alloy, which is nickel-based, chromium-based or cobalt-based, wherein at least one buffer layer is of an alloy and is located in between the base portion of austenitic, stainless steel and the outer portion, wherein the alloy of the buffer layer has an alloy composition different from the austenitic, stainless steel of the base portion and different from the hot-corrosion-resistant alloy of the outer portion, wherein the alloy of the buffer layer comprises from 0% to at the most 0.09% C in percent by weight of the buffer layer, wherein the buffer layer has a thickness of at least 1.5 mm, and wherein the buffer layer restricts diffusion of carbon from the austenitic, stainless steel of the base portion to the hot-corrosion-resistant alloy of the outer portion.

2. A movable wall member according to claim 1, wherein the buffer layer is of steel, such as an austenitic steel.

3. A movable wall member according to claim 1, wherein the buffer layer is of a nickel-based alloy.

4. A movable wall member according to claim 1, wherein the buffer layer, apart from unavoidable impurities, is one of Fe or Ni.

5. A movable wall member according to claim 1, wherein the buffer layer has a thickness of at least 2 mm.

6. A movable wall member according to claim 1, wherein the engine is a two-stroke crosshead engine.

7. A method of manufacturing a movable wall member in form of an exhaust valve spindle or a piston for an internal combustion engine, comprising the following steps:

providing a base portion of the moveable wall member, which base portion comprises an alloyed steel having a carbon-content in the range from 0.15 to 0.35% by weight, providing an outer portion, which outer portion is of a hot-corrosion-resistant alloy, which is nickel-based, chromium-based or cobalt-based, placing a buffer layer on the base portion and then placing the outer portion on the buffer layer, which buffer layer is of an alloy comprising from 0% to at the most 0.09% C in percent by weight of the buffer layer and having an alloy composition different from the alloyed steel of the base portion and different from the hot-corrosion-resistant ally of the outer portion, said base portion, buffer layer and outer portion being unified to a coherent wall member with the buffer layer located in between the base portion of alloyed steel and the outer portion, in which wall member the buffer layer prevents diffusion of carbon from the alloyed steel of the base portion to the hot-corrosion-resistant alloy of the outer portion.

8. A method of manufacturing a movable wall member according to claim 7, wherein the buffer layer is a sheet of plate placed on the base portion and the outer portion is deposited on an outer surface of the sheet of plate.

9. A method of manufacturing a movable wall member according to claim 7, wherein the base portion is a pre-machined blank of forged valve steel, and the outer portion is a nickel-based alloy provided as a particulate material which is unified by a HIP process substantially without melting the particulate material.

10. A method of manufacturing a movable wall member according to claim 7, wherein the buffer layer is provided as a particulate material which is unified by a HIP process.

11. A method of manufacturing a movable wall member according to claims 7, wherein the buffer layer is deposited on the base portion by welding.

12. A movable wall member in form of a piston for an internal combustion engine, which piston comprises:

a base portion of an alloyed steel having a carbon-content in the range from 0.15 to 0.35% by weight, and an outer portion forming a surface of the piston for facing a combustion chamber, which outer portion is of a hot-corrosion-resistant alloy, which is nickel-based, chromium-based or cobalt-based, wherein at least one buffer layer is of an alloy and is located in between the base portion and the outer portion, wherein the alloy of the buffer layer has an alloy composition different from the alloyed steel of the base portion and different from the hot-corrosion-resistant alloy of the outer portion, wherein the alloy of the buffer layer comprises from 0% to at the most 0.09% C in percent by weight of the buffer layer, wherein the buffer layer has a thickness of at least 1.5 mm, and wherein the buffer layer restricts diffusion of carbon from the alloyed steel of the base portion to the hot-corrosion-resistant alloy of the outer portion.

13. A movable wall member according to claim 12, wherein the buffer layer has a thickness of at least 2 mm.

14. A movable wall member according to claim 13, wherein the engine is a two-stroke crosshead engine.

* * * * *